US009145878B1

(12) United States Patent
McKenzie et al.

(10) Patent No.: US 9,145,878 B1
(45) Date of Patent: Sep. 29, 2015

(54) OSCILLATING LINEAR COMPRESSOR

(71) Applicants: Marvin Ray McKenzie, Dothan, AL (US); McKinley L. Chaney, Madison, AL (US)

(72) Inventors: Marvin Ray McKenzie, Dothan, AL (US); McKinley L. Chaney, Madison, AL (US)

( * ) Notice: Subject to any disclaimer, the term of this patent is extended or adjusted under 35 U.S.C. 154(b) by 0 days.

(21) Appl. No.: 14/329,178

(22) Filed: Jul. 11, 2014

(51) Int. Cl.
*F04B 35/04* (2006.01)
*F04B 17/03* (2006.01)
*F04B 39/00* (2006.01)

(52) U.S. Cl.
CPC ..... *F04B 35/045* (2013.01); *F04B 17/03* (2013.01); *F04B 35/04* (2013.01); *F04B 39/0016* (2013.01)

(58) Field of Classification Search
CPC ..... F04B 35/045; F04B 39/0016
USPC ..... 417/415–418; 310/15–24
See application file for complete search history.

(56) References Cited

U.S. PATENT DOCUMENTS

| | | | | |
|---|---|---|---|---|
| 2,853,229 | A | 11/1953 | Dolz | |
| 3,171,585 | A | 3/1965 | Gauss | |
| 3,597,122 | A | 8/1971 | Farmer | |
| 3,894,817 | A * | 7/1975 | Majoros et al. | 417/415 |
| 4,121,125 | A * | 10/1978 | Dolz | 310/27 |
| 4,781,546 | A * | 11/1988 | Curwen | 417/417 |
| 8,062,005 | B2 | 11/2011 | Hansen et al. | |
| 2005/0057101 | A1 * | 3/2005 | Nakagawa et al. | 310/12 |
| 2013/0034456 | A1 * | 2/2013 | Schoegler | 417/410.1 |

* cited by examiner

*Primary Examiner* — Peter J Bertheaud
*Assistant Examiner* — Dominick L Plakkoottam
(74) *Attorney, Agent, or Firm* — Ann I. Dennen; Lanier Ford Shaver & Payne P.C.

(57) ABSTRACT

An oscillating linear compressor includes a cylindrical chassis defining a chamber and comprising a plurality of elongated chassis frame members extending between either end of the chassis. The chassis houses a compression cylinder that receives a linearly-driven piston that is connected to a voice coil. A power distribution assembly couples current to the voice coil providing oscillating magnetic field and comprises a plurality of electrically conductive linear bearings coupled to a power supply that are configured to facilitate substantially frictionless, bi-directional travel of the piston. One or more permanent magnets mounted to the elongated chassis frame members providing a permanent magnetic field with which the voice coil's oscillating magnetic field interacts.

22 Claims, 6 Drawing Sheets

OSCILLATING LINEAR COMPRESSOR

BRIEF DESCRIPTION OF THE DRAWINGS

The oscillating linear compressor set forth below is described with reference to the accompanying drawings. In the drawings, like reference numbers indicate identical or functionally similar elements.

DETAILED DESCRIPTION

Figure 1:
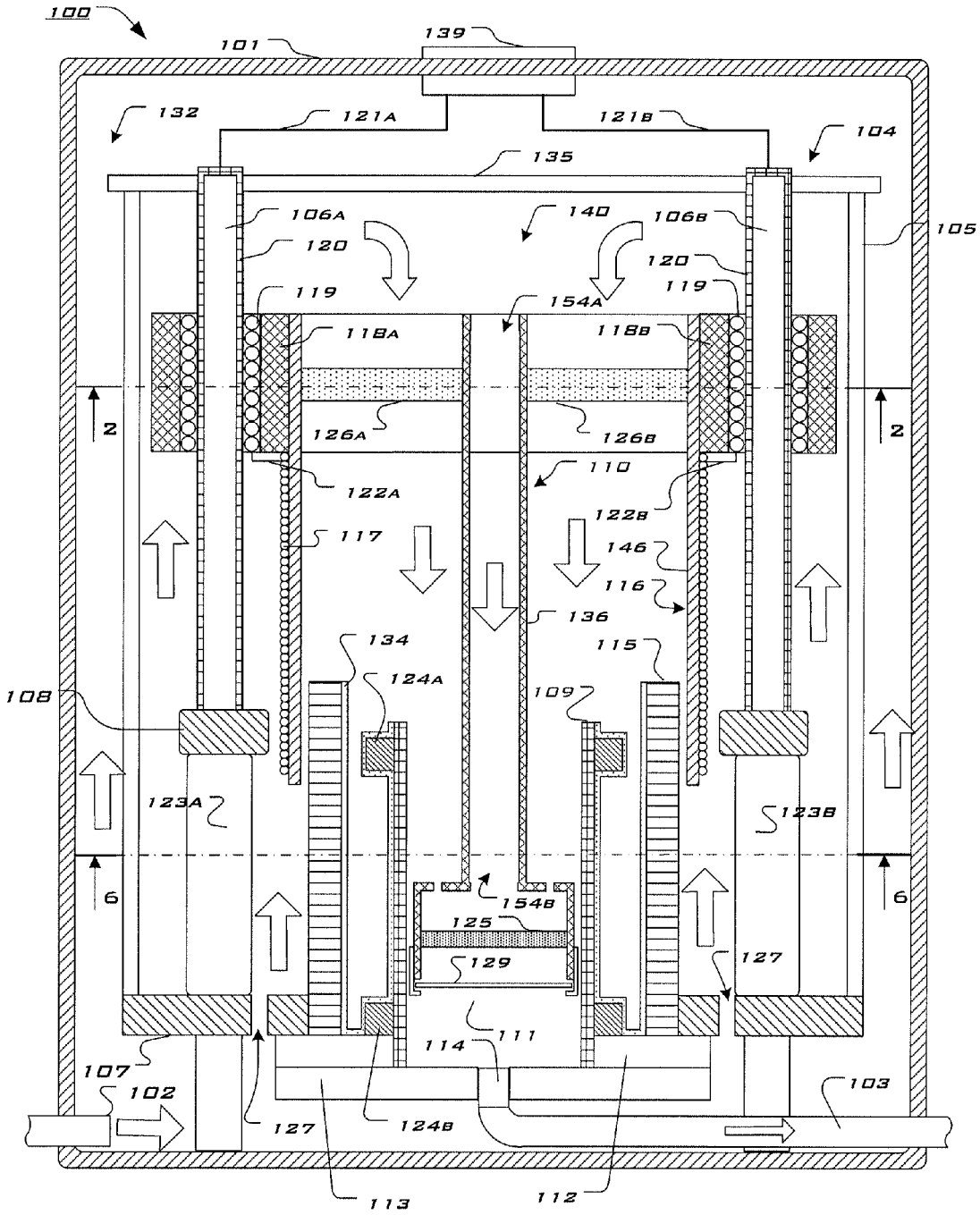
FIG. 1 is a section view an exemplary compressor.
Figure 2:
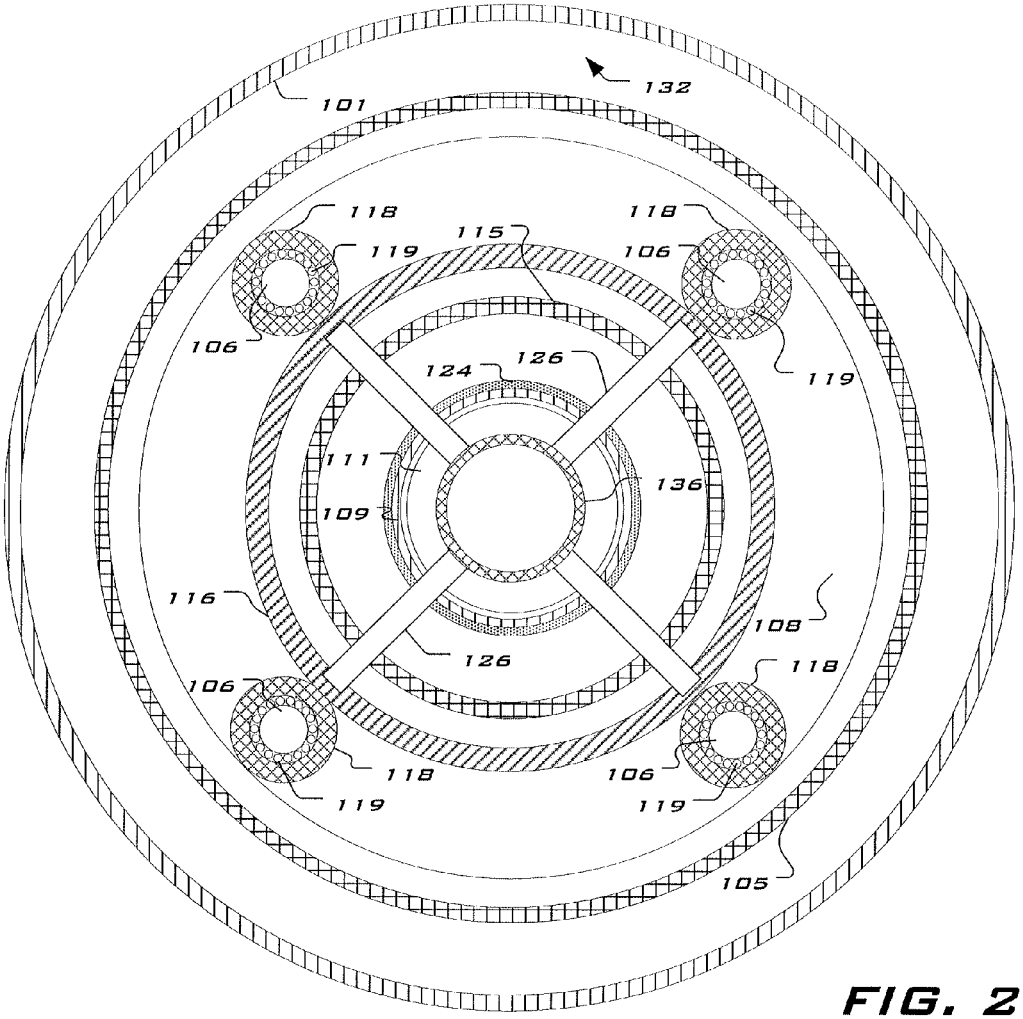
FIG. 2 is a section view of the interior, along line 2-2, of the compressor shown in FIG. 1.
Figure 5:
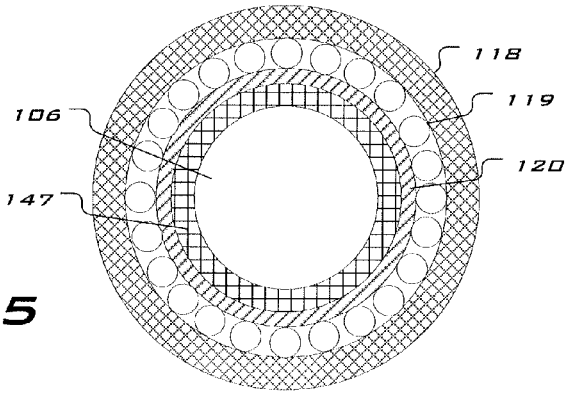
FIG. 5 is a section view of an exemplary frame member including an insulation layer, a conductive encasement and a linear bearing.
Figure 3:
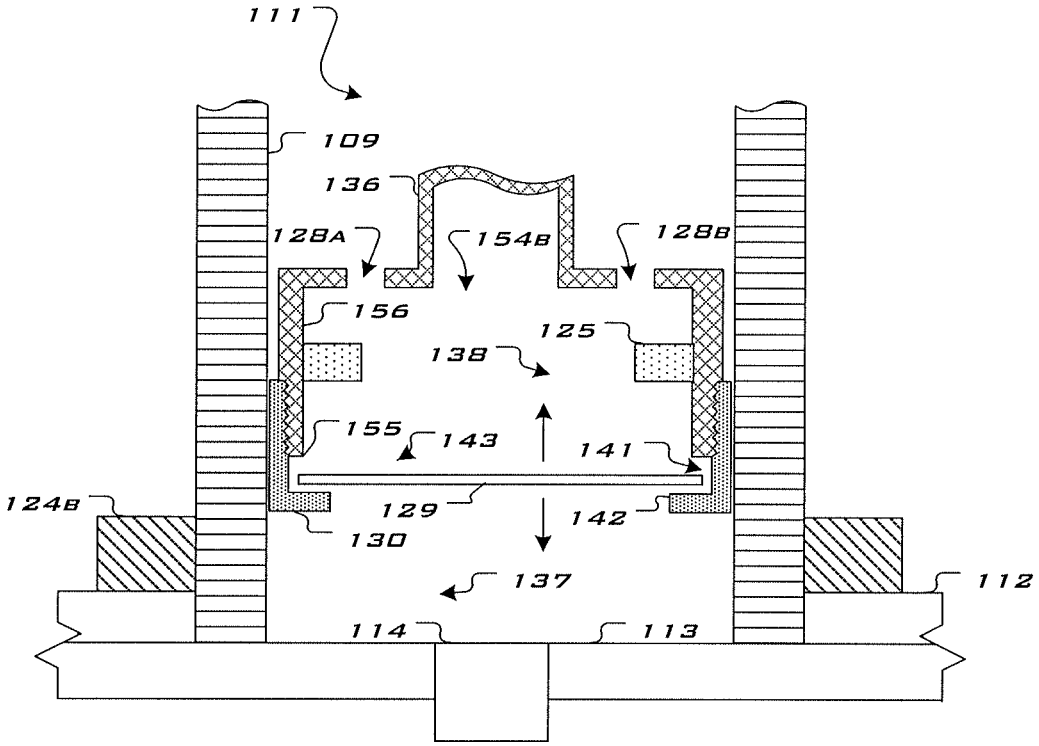
FIG. 3 is a detailed view of an exemplary piston assembly.

The various embodiments of the compressor and their advantages are best understood by referring to FIG. 1 through 8. The elements of the drawings are not necessarily to scale, emphasis instead being placed upon clearly illustrating the novel features and principles of operation.

Furthermore, reference in the specification to "an embodiment," "one embodiment," "various embodiments," or any variant thereof means that a particular feature or aspect described in conjunction with the particular embodiment is included in at least one embodiment. Thus, the appearance of the phrases "in one embodiment," "in another embodiment," or variations thereof in various places throughout the specification are not necessarily all referring to its respective embodiment.

A compressor 100 comprises a generally cylindrical casing 101 defining a hollow chamber 132 within which is housed a chassis 104 including a top plate 135 and pole plate 107 connected together with a plurality of frame members 106*a-d* (which may comprise threaded bolts), and a cylindrical chassis body 105 defining a second hollow chamber 140. A fluid inlet 102 extends through the casing 101 and is in fluid communication with the hollow chamber 132. An outlet 103 also extends through the casing 101. The pole plate 107 includes a plurality of openings 127 defined through the plate 107.

A piston assembly 111 is connected to an elongated, hollow push tube 136 having open distal ends 154*a, b*. The piston assembly 111 comprises a crown member 156 defining a hollow chamber 138 in communication with one or more inlets 128 thereto defined in the crown member 156 adjacent the push tube 136, the chamber 138 having an open end 143 bounded by a rim 155. An annular ring lid 130 is engaged with the open end 143 of the crown member 156 such that a space 141 is interposed between the rim 155 of the crown member 156 and the rim 142 of the ring lid 130. In one embodiment, the ring lid is a threaded female member that is threadably engaged with counterpart threads of the crown member 156.

Figure 4:
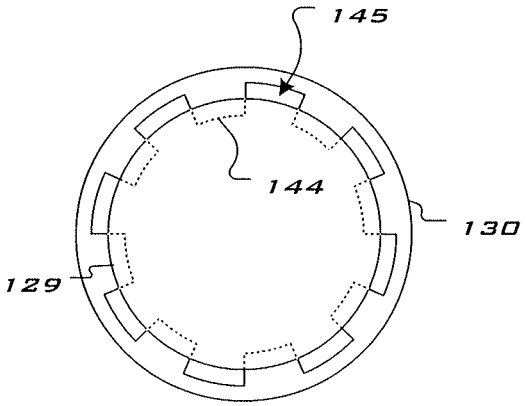
FIG. 4 is a detailed plan view of the one-way valve depicted in FIG. 3.
Figure 6:
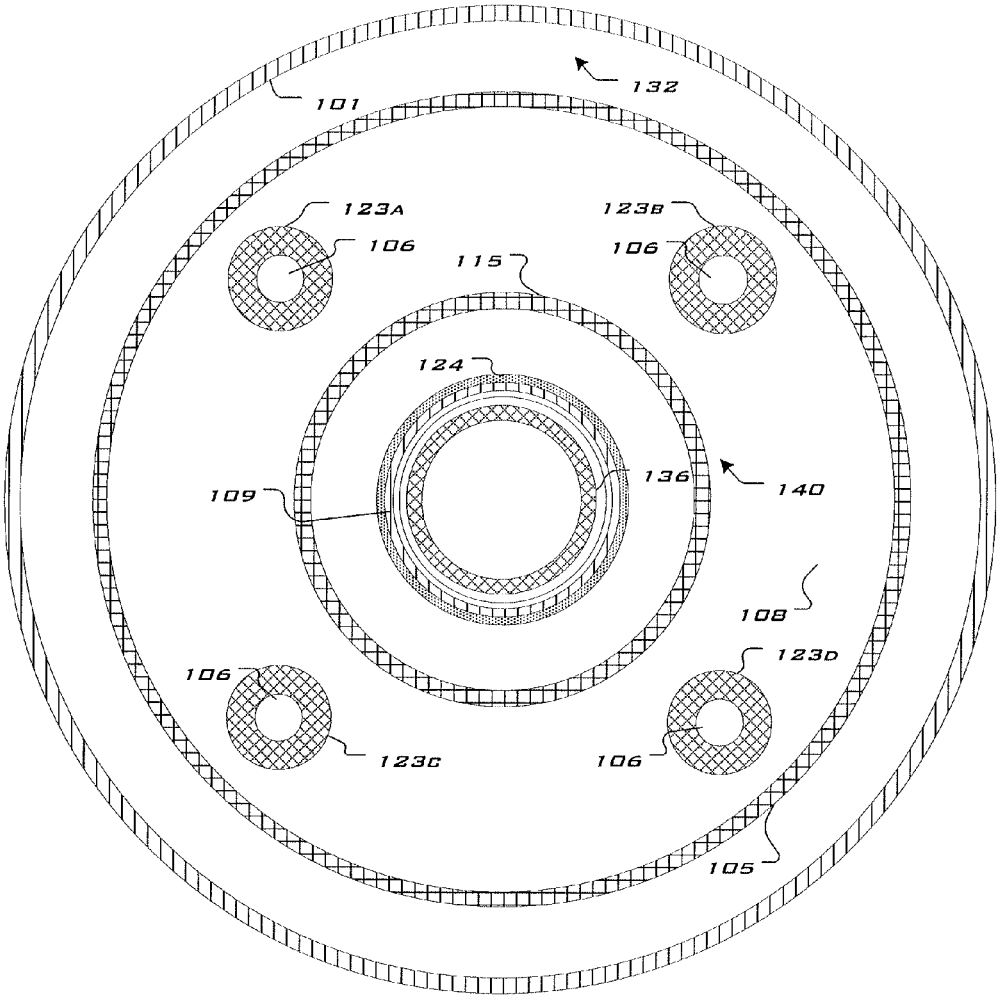
FIG. 6 is a section view of the compressor of FIG. 1 along line 6- 6.

In another embodiment (not shown), the ring lid 130 may be a snap ring that engages a lip or flange that extends outwardly from the crown member 156. A floating, one-way valve member 129 is disposed within the space 141 and is allowed to move within the space 141 as will be described below, and is preferably comprised of a strong, lightweight material, such as titanium or graphene. Ring lid rim 142 is configured with a radially inward circumferential castellated edge 144, as shown in FIG. 4. Valve member 129 overlays the castellated edge 144 and comprises a diameter such that notches 145 are created between the outer edge of valve member and the castellated edge 144 of the ring lid 130. The crown member 156 further comprises a permanent ring magnet 125 disposed within the piston chamber 138.

Piston assembly 111 is received with a cylinder 109 that defines a compression chamber 137 and that is mounted to a cylinder head 113 within a cylinder head plate 112. A pressure valve 114 provides an outlet for the cylinder chamber 137. The pressure valve 114 is in fluid communication with the compressor fluid outlet 103. Cylinder 109 also includes a pair of permanent ring magnets 124*a, b* disposed and either end of the cylinder 109, and oriented such that their respective polarities are opposite the polarity to the piston magnet 125. In other words, both cylinder ring magnets 124*a, b* will be oriented having their respective poles in the same direction while the piston ring magnet 125 will be oriented in the opposite direction. Preferably, cylinder magnets 124*a, b* and piston magnet 125 comprise a permanent magnetic material able to withstand high temperatures generated within the compression chamber without weakening of its magnetic field. One suitable magnet is a samarium-cobalt magnet which exhibits a relatively high Curie Temperature of up to about 800° C. Cylinder 109 is seated concentrically within a cylindrical yoke 115 attached to the cylinder head plate 112.

Compressor 100 further comprises a power distribution assembly that includes an AC power connector 139 having power supply leads 121 in contact with frame members 106 extending from top plate 135 to pole plate 107 with ends preferably mounted to an interior wall of the casing 101. Each frame member 106 is encased in an electrically conductive encasement 120. Encasement 120 is in electrical contact with supply leads 121. Frame members 106 also preferably comprise an electrical insulator 147, such as Garolite, disposed between the frame member 106 and the encasement 120. Frame members 106 extend through a pole ring 108 and one or more permanent magnets 123*a-d* disposed between the pole ring 108 and the pole plate 107. It will be appreciated that permanent magnets 123 preferably comprise a magnetic material having a relatively high magnetic field strength, and a relatively high Curie Temperature, for example, neodymium magnets.

A voice coil 116 is attached to the push tube 136 at the end opposite the piston assembly 111 by a plurality of attachment members 126*a-d* which may be set screws. The voice coil 116 is also attached to linear bearings 118 rollingly engaged with frame members 106, each linear bearing 118 comprising a plurality of ball bearings 119 that are formed from an electrically conductive material and that are in contact with the electrically conductive frame member encasements 120. Linear bearings 118 provide a guide for the voice coil 116 to travel linearly along the frame members 106 bi-directionally, while stabilizing the piston assembly 111 in the radial plane with respect to the center of the compressor 100.

Voice coil 116 comprises a former 146 that defines a cylindrical form for an electrically conductive winding 117 in electrical contact with the ball bearings 119 through leads 122*a, b*. Former 146 is preferably formed from a lightweight, thermally conductive material, but one with dielectric properties to mitigate the occurrence of eddy currents.

In one embodiment, one example of a suitable material to comprise the former 146 is a dielectric polymer sold under the trademark, Kapton®, by E. I. Du Pont De Nemours And Company Corporation. Another advantage of using Kapton® is its light weight which decreases the inertia of the piston assembly 111 taking less energy to initiate the motion of the piston 111 in either direction. However, Kapton® is also known to be heat resistant, i.e., exhibits relatively low thermal conductivity. To increase efficiency and to prolong the life of the mechanism, it is important to remove as much heat as possible from the interior of the former. Accordingly, to enhance the thermal conductivity of the voice coil, winding 117 may be applied to the former 146 such that the conductor is encapsulated with a resin that includes diamond particles, or other thermally conductive material, to enhance or add thermal conductivity of the former 146 and aid in removing heat from the interior of the voice coil.

In one embodiment, winding 117 comprises a wound flattened conductor to reduce the thickness of the winding 117, and also may be double-wound, i.e., wound about the former 146 in two or more layers to increase the induced magnetic field strength while reducing the height and width of the coil. Winding 117 may also be applied to the former 146 on the outer or inner circumferential surfaces, or on both. Thus, the inventors hereof have achieved a compressor having a voice coil 116 with about a four-inch height. This reduces the overall size of the compressor, shortens the piston stroke, but still maintains high compression as would be appreciated by those skilled in the art having the benefit of this disclosure.

As will be described in greater detail hereafter, compressor comprises a linear motor. It will therefore be appreciated that using a linear motion reduces or eliminates energy loss due to friction generated by movement of the piston assembly 111 against the interior surface of the cylinder 109, as experienced with conventional rotary compressor designs. It also reduces radial energy loss due to friction generated in a rotary system comprising a crank, drive rod, wrist pin and piston. A linear motor as described herein also permits a variable stroke that is capable of developing more energy efficiency. Further, the cylinder 109 may be formed from a high-strength material with a low coefficient of friction which may be a metal alloy, suitable examples of which are AMS 4533 (beryllium-copper alloy) and a copper alloy sold under the mark, Toughmet®, by Materion Performance Alloys.

In operation, AC electrical power from the power connector 139 is coupled to the respective electrically conductive encasements 120 via leads 121*a, b*, and, in turn, electrical power is coupled through the ball bearings 119 to the voice coil 116 via leads 122*a, b*. When the voice coil 116 is energized a magnetic field is generated which interacts with the magnetic fields of the permanent magnets 123*a-d* which are oriented such that their respective polarities are in the same direction. The field from the voice coil 116 interacts with the fields from the permanent magnets 123*a-d* such that AC power applied to the voice coil 116 in one polarity attracts the voice coil 116 toward one pole of the magnets. On the other hand, AC power of opposite polarity attracts the voice coil 116 toward the opposite pole of the magnets 123*a-d*. Accordingly, since the voice coil 116 is attached to push tube 136, the piston assembly 111 is actuated in a linear oscillatory fashion, oscillating at a frequency substantially the same as that of the AC power.

As the piston assembly 111 is urged in either direction, the magnetic field produced by piston magnet 125 within the crown member 156 interacts with the respective magnetic fields of the upper and lower cylinder magnets 124*a, b* disposed at either end of the cylinder 109. The piston magnet 125 is oriented within the piston head chamber 138 such that its polarity is opposite that of the cylinder magnets 124*a, b*. Consequently, when the piston assembly 111 is drawn upward, the piston magnet 125 and the upper cylinder magnet 124*a* repulse each other and the piston is prevented from further upward motion. Likewise, when the piston assembly 111 is urged downward on a compression stroke, repulsive force between the piston magnet 125 and the lower cylinder magnet 124*b* prevents further downward motion. Thus, cylinder magnets 124*a, b* and their interaction with the piston magnet 125 operate to increase the acceleration of the piston assembly 111 toward the down stroke when the piston assembly 111 nears the top of the upstroke, as well as to increase acceleration toward the upstroke when the piston assembly 111 approaches the bottom of the down stroke. This results in a faster direction reversal when the AC power changes and greater force in each direction, which translates to greater efficiency in a significantly more compact space compared to compressors of the prior art. Additionally, this arrangement also acts to dampen the stroke of the piston, performing the function of mechanical dampening springs in conventional linear motors, while also stabilizing the piston assembly 111 radially within the cylinder 109 to limit contact between the head 111 and the cylinder 109 interior surface. It will be appreciated that eliminating these mechanical springs significantly increases reliability of the present compressor since such springs are subject to failure over time.

Cold fluid is drawn into the first hollow chamber 132 through inlet 102 and then into the inner hollow chamber 140 through openings 127 in the pole plate 107. Fluid flows from the openings 127 into the inner chamber 140 around the linear bearings 118, over the top of the voice coil 116, into the hollow push tube 136 and downward again toward the piston assembly 111, generally as shown by the reference arrows. Fluid, which at this point is between about 40° F. and about 50° F., continues to flow over the exterior and through the interior of the voice coil 116, removing heat and preventing the voice coil 116 from overheating. This cool fluid also enters the push tube 136 through opening 154*a*, cooling the tube 136, and into the cylinder 109 and piston head chamber 138. On the upstroke of the piston assembly 111, fluid is taken into the chamber 138 in the crown member 156 through openings 128 and the lower opening 154*b* in the push tube 136.

Concurrently, floating valve member 129, being unattached, is urged against the rim 142 of the lid 130 and is seated against the castellated edge 144. As such, fluid is permitted to enter the compression chamber 137 from the piston head chamber 138 through the castellated edge's notches 145. On the down stroke, the floating valve member 129 rises inside the space 141 and is seated against the rim 155 of the crown member 156, preventing fluid in the compression chamber 137 from entering the piston head chamber 138 as the piston assembly 111 is forced down into the cylinder 109. Accordingly, fluid in the compression chamber 137 is heated by compression and is then forced through the pressure valve 114 and through the outlet 103 when fluid pressure reaches the relief threshold of the valve 114.

To further mitigate heat loss and to protect the magnets 123, yoke 115, and the winding 117, the cylinder 109 exterior may advantageously be coated with an insulator 134. Because of the limited space surrounding the cylinder 109 exterior, the insulator 134 should be thin, but still possessed of a relatively high thermal resistance (R-value), for example, the Temp-Coat® insulation product, sold by Temp-Coat Brand Products, LLC. In doing so, inventors achieve a 3-5% increase in compressor efficiency compared to conventional compressors.

In another embodiment, the pole ring 108, pole plate 107 or the yoke 115, or all of them, may be comprised of a ferrous substance. Accordingly, the pole ring 108, the pole plate 107 or the yoke 115, may interact with the magnetic fields of the permanent magnets 123*a-d*, advantageously shaping or directing the magnetic field into a modified "horseshoe"-like shape that interacts with the changing magnetic field of the voice coil 116.

Figure 7:
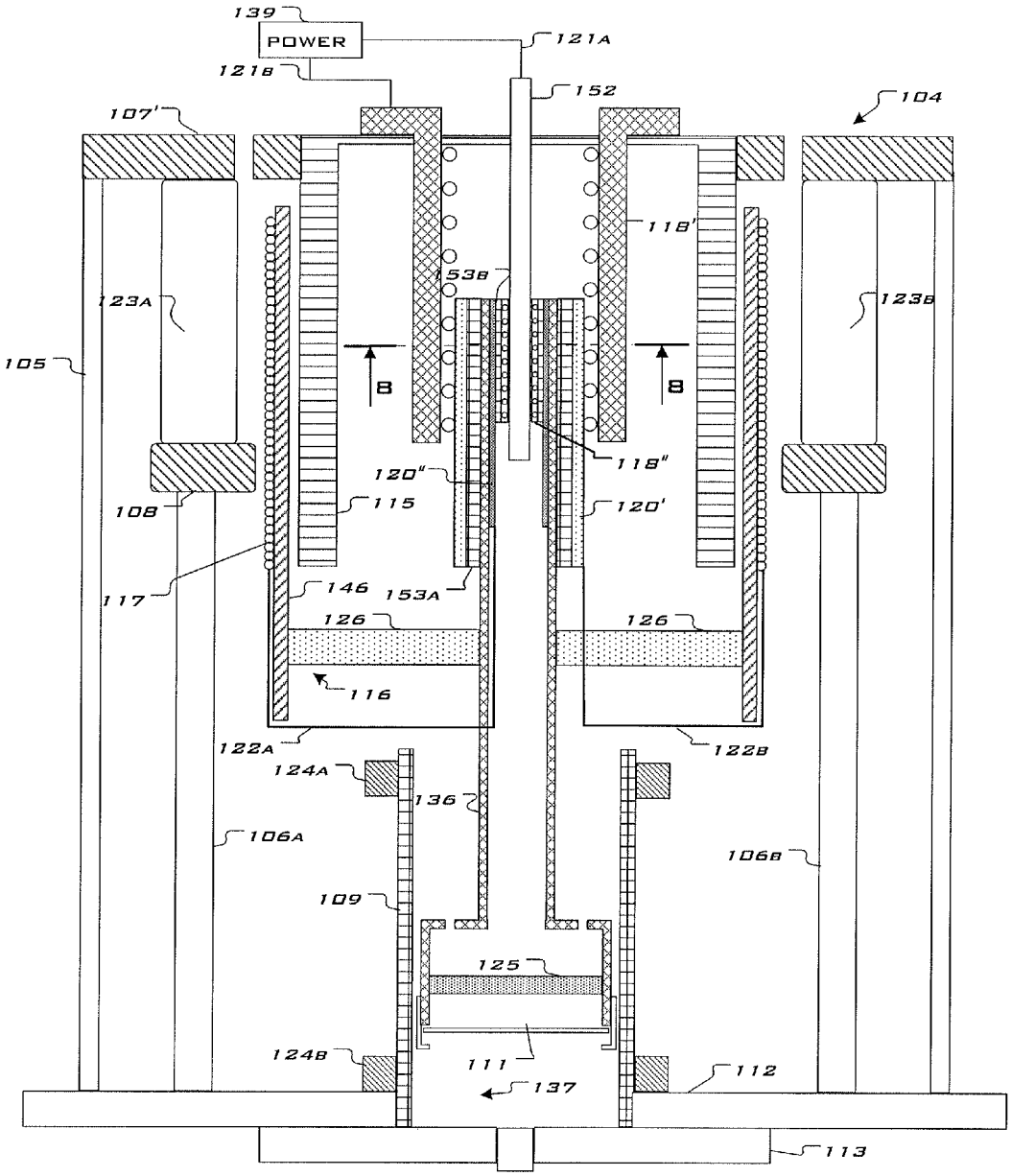
FIG. 7 is a section view of another exemplary embodiment of a compressor.
Figure 8:
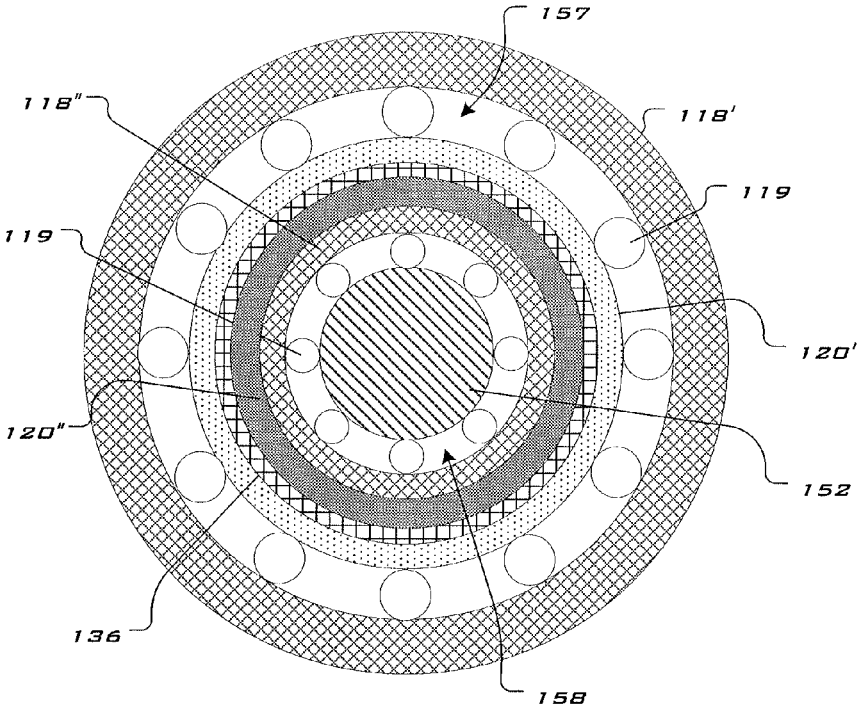
FIG. 8 is a section view of a portion of the compressor illustrated in FIG. 7 along line 8-8.

With reference to FIGS. 7 and 8, another exemplary embodiment of an oscillating linear compressor 100' according to the principles of this disclosure is illustrated. As with versions described above, a compressor 100' comprises a cylindrical casing 101 defining a hollow chamber 132 (not pictured), in which is concentrically housed a cylindrical chassis 104.

In this embodiment, chassis 104 comprises a cylinder head plate 112 supporting a cylinder head 113 and connected to a pole plate 107 by elongated frame members 106*a-d* therebetween, and a cylindrical chassis body 105 surrounding the assembly and defining a second hollow chamber 140. A cylinder 109 is concentrically mounted to the cylinder head 113 and defines a compression chamber 137 in which is received a piston assembly 111, as described above, extending from one end of an elongated, hollow push tube 136.

Within the chassis 104, frame members 106 extend between the cylinder head plate 112 and pole plate 107 and support permanent magnets 123 mounted thereon disposed between the pole plate and a pole ring 108 situated about midway along the frame members 106. As in the previously-described embodiment, magnets 123 may be neodymium, and pole plate 107 and pole ring 108 may comprise ferrous materials.

A cylindrical yoke 115 is concentrically mounted to the pole plate 107' and extends from the plate 107' into the second hollow chamber 140. Concentrically mounted within the yoke 115 is a first linear bearing 118' formed of an electrically conductive material and comprising a plurality of ball bearings 119, also formed of an electrically conductive material. First linear bearing further a flange 160 disposed on the exterior side of the pole plate 107 with respect to the chassis 104. A power rod 152 extends from the exterior of the chassis 104 through the center of pole plate 107' and into the chamber 140. Power rod 152 is coupled to a power connector 139 via lead 121 and comprises an electrically conductive material.

The end of the hollow push tube 136 opposite the piston assembly 111 is open and is surrounded on its exterior surface by a conductive sleeve 120' that is rollingly engaged by the ball bearings 119 of the first linear bearing 118'. A layer of insulating material 153*a*, e.g., Garolite, may be interposed between the conductive sleeve 120' and the surface of the push tube 136. A second linear bearing 118" is seated within the open end of the hollow push tube 136 and is formed of an electrically conductive material and comprising a plurality of ball bearings 119, also formed of an electrically conductive material, and that are rollingly engaged about the surface of the power rod 152. An outer channel 157 is defined in the space between the first linear bearing 118' and the surface of the conductive sleeve 120', and an inner channel 158 is defined in the space between the second linear bearing 118" and the power rod 152. A second insulating layer 153*b* may also be interposed between the second linear bearing 118" and the interior surface of the push tube 136. It should be noted that neither insulating layer is depicted in FIG. 8 for clarity.

A voice coil 116, as described above, is attached to the push tube 136 via attachment members 126 located roughly midway along the push tube 136 to an interiorly disposed end of the voice coil 116. The voice coil 116 extends from the interior of the chamber toward the pole plate 107' and surrounds the yoke 115. Winding 117 is wound about the former 146 and positioned such that it will be affected by the magnetic fields of the permanent magnets 123*a, b*.

As described above, power rod 152 is coupled to power connector 139 via lead 121*a*. When energized, current is coupled from the power rod 152 to ball bearings 119 of the second linear bearing 118" which, in turn, couples current to an inner conductive sleeve 120" connected to current supply lead 122*a* which conducts current to the winding 117. A neutral lead 122*b* is connected to the opposite end of the winding 117 and is connected to the outer conductive sleeve 120' which couples the current to the outer linear bearing 118' and through neutral lead 121*b*.

Similar to the embodiments described above, when the voice coil 116 receives current a magnetic field is induced in the winding 117 which interacts with the fields of the permanent magnets 123, as may be modified by the pole plate 107' and the pole ring 108. Current applied in one direction causes the voice coil 116 to be attracted toward the magnets 123. The push tube 136 through its connection with the voice coil 116 is then pulled away from the cylinder 109 and the piston assembly 111 is drawn on its upstroke. Current applied in the opposite direction causes the voice coil 116 to be repulsed from the magnets 123, thus urging the push tube 136 into the cylinder 109 and actuating the piston assembly on its down stroke.

Those skilled in the relevant arts will appreciate the above-described compressor solves many of the shortcomings found in the prior art. The flow if the fluid within the housing 101 and the chassis 105 significantly reduces heat generated within the cylinder 109 during operation. The design is scalable such that simply changing the diameters of the cylinder 109 and the piston assembly 111 allows the compressor to accommodate a variety of refrigerants so that the same housing and chassis arrangement may be used for different applications.

This compressor is also capable of operation over a broad range of power and frequency, e.g., from 0V AC to 260V AC, and from about 30 Hz to about 100 Hz, respectively. Consequently, the compressor offers a "soft" start feature resulting in less energy lost compared to the starting operations of conventional compressor systems. Further this compressor is capable of generating up to 3600 W of power and from about 1 Tons to more than 5 Tons of HVAC capacity.

Another shortcoming in conventional compressors is the tendency to experience failure due to hydraulic lock, which occurs when more fluid in the compression chamber is more than the system is able to press out of the cylinder and leads to catastrophic failure through damage to the piston. This often occurs with such prior compressors are laid on the side when not in operation, e.g., shipping or storage, which allows fluid to accumulate in the compression chamber. Because of the dual housing configuration and the more centrally located openings 127 in the pole plate 107, if this compressor is laid on its side, the fluid accumulates in the housing and not in the chassis or the compression chamber.

As described above and shown in the associated drawings, the present invention comprises an oscillating linear compressor. While particular embodiments have been described, it will be understood, however, that any invention appertaining to the apparatus described is not limited thereto, since modifications may be made by those skilled in the art, particularly in light of the foregoing teachings. It is, therefore, contemplated by the appended claims to cover any such modifications that incorporate those features or those improvements that embody the spirit and scope of the invention.

What is claimed is:

1. An oscillating linear compressor comprising:

a cylindrical chassis defining a chamber and comprising a plurality of elongated frame members extending between either end of said chassis;

a compression cylinder concentrically disposed within said chamber and defining a compression chamber;

a piston assembly comprising a piston configured to compress fluid within said compression chamber; a push tube extending from said piston assembly out of said compression chamber for bi-directionally actuating the piston within said compression chamber;

a voice coil connected to said push tube;

a power distribution assembly for coupling current to said voice coil and inducing an oscillating magnetic field about said voice coil, said power distribution assembly comprising a plurality of electrically conductive linear bearings coupled to a power supply and are configured to facilitate substantially frictionless, bi-directional travel of said push tube; and one or more permanent magnets mounted to said plurality of elongated frame members and disposed about the exterior of said cylinder for providing a permanent magnetic field with which said oscillating magnetic field interacts.

2. The oscillating linear compressor of claim 1, wherein each of said plurality of linear bearings are in rolling engagement with respective frame members of said plurality of elongated frame members, said respective frame members coupled to said power supply and comprising a conductive material for coupling current from said power supply to said each of said plurality of linear bearings, said plurality of linear bearings being attached to said voice coil.

3. The oscillating linear compressor of claim 1, further comprising an electrically conductive rod extending along a central axis of said chamber, coupled to said power supply and in rolling engagement with a first linear bearing attached to said push tube which is in rolling engagement with a second linear bearing and wherein said plurality of linear bearings consists of said first linear bearing and said second linear bearing.

4. The oscillating linear compressor of claim 1, further comprising:

first and second permanent ring magnets mounted to said compression cylinder at opposite ends thereof and oriented such that their respective poles are in the same direction; and a piston ring magnet disposed within a piston chamber defined within said piston and oriented such that its poles are in the opposite orientation with respect to said respective poles of said first and second magnets.

5. The oscillating linear compressor of claim 4, wherein each of said plurality of linear bearings are in rolling engagement with respective frame members of said plurality of elongated frame members, said respective frame members coupled to said power supply and comprising a conductive material for coupling current from said power supply to said each of said plurality of linear bearings, said plurality of linear bearings being attached to said voice coil.

6. The oscillating linear compressor of claim 4, further comprising an electrically conductive rod extending along a central axis of said chamber, coupled to said power supply and in rolling engagement with a first linear bearing attached to said push tube which is in rolling engagement with a second linear bearing and wherein said plurality of linear bearings consists of said first linear bearing and said second linear bearing.

7. The oscillating linear compressor of claim 1, wherein said voice coil comprises a dielectric, thermally conductive material.

8. The oscillating linear compressor of claim 7, wherein each of said plurality of linear bearings are in rolling engagement with respective frame members of said plurality of elongated frame members, said respective frame members coupled to said power supply and comprising a conductive material for coupling current from said power supply to said each of said plurality of linear bearings, said plurality of linear bearings being attached to said voice coil.

9. The oscillating linear compressor of claim 7, further comprising an electrically conductive rod extending along a central axis of said chamber, coupled to said power supply and in rolling engagement with a first linear bearing attached to said push tube which is in rolling engagement with a second linear bearing and wherein said plurality of linear bearings consists of said first linear bearing and said second linear bearing.

10. The oscillating linear compressor of claim 7, further comprising:

first and second permanent ring magnets mounted to said compression cylinder at opposite ends thereof and oriented such that their respective poles are in the same direction; and a piston ring magnet disposed within a piston chamber defined within said piston and oriented such that its poles are in the opposite direction with respect to said respective poles of said first and second magnets.

11. The oscillating linear compressor of claim 10, wherein each of said plurality of linear bearings are in rolling engagement with respective frame members of said plurality of elongated frame members, said respective frame members coupled to said power supply and comprising a conductive material for coupling current from said power supply to said each of said plurality of linear bearings, said plurality of linear bearings being attached to said voice coil.

12. The oscillating linear compressor of claim 10, further comprising an electrically conductive rod extending along a central axis of said chamber, coupled to said power supply and in rolling engagement with a first linear bearing attached to said push tube which is in rolling engagement with a second linear bearing and wherein said plurality of linear bearings consists of said first linear bearing and said second linear bearing.

13. The oscillating linear compressor of claim 10, further comprising a floating valve for regulating fluid communication through an open end of said piston chamber.

14. The oscillating linear compressor of claim 13, wherein each of said plurality of linear bearings are in rolling engagement with respective frame members of said plurality of elongated frame members, said respective frame members coupled to said power supply and comprising a conductive material for coupling current from said power supply to said each of said plurality of linear bearings, said plurality of linear bearings being attached to said voice coil.

15. The oscillating linear compressor of claim 13, further comprising an electrically conductive rod extending along a central axis of said chamber, coupled to said power supply and in rolling engagement with a first linear bearing attached to said push tube which is in rolling engagement with a second linear bearing and wherein said plurality of linear bearings consists of said first linear bearing and said second linear bearing.

16. The oscillating linear compressor of claim 13, further comprising:

first and second permanent ring magnets mounted to said compression cylinder at opposite ends thereof and oriented such that their respective poles are in the same direction; and a piston ring magnet disposed within a piston chamber defined within said piston and oriented such that its poles are in the opposite direction with respect to said respective poles of said first and second magnets.

17. The oscillating linear compressor of claim 16, wherein each of said plurality of linear bearings are in rolling engagement with respective frame members of said plurality of elongated frame members, said respective frame members coupled to said power supply and comprising a conductive material for coupling current from said power supply to said each of said plurality of linear bearings, said plurality of linear bearings being attached to said voice coil.

18. The oscillating linear compressor of claim 16, further comprising an electrically conductive rod extending along a central axis of said chamber, coupled to said power supply and in rolling engagement with a first linear bearing attached to said push tube which is in rolling engagement with a second linear bearing and wherein said plurality of linear bearings consists of said first linear bearing and said second linear bearing.

19. A compressor comprising:

a compression cylinder having a cylinder head and an open end;

first and second cylinder magnets disposed at either end of said compression cylinder;

a piston dimensioned to be received within said compression cylinder and actuated by an elongated actuator member and comprising a piston magnet oriented such that either cylinder magnet repulses said piston magnet;

a voice coil concentrically attached to said elongated actuator member and comprising a cylindrical former supporting a conductor wound around the circumference of said former;

a plurality of linear bearings configured to guide linear motion of said elongated actuator member, said linear bearings being in electrical contact with said conductor and a power supply such that an electrical current may be applied to said conductor to induce an oscillating magnetic field about said voice coil;

a plurality of elongated frame members disposed in parallel around the radial exterior of said voice coil and said cylinder; and one or more permanent magnets mounted to said frame members and emitting a magnetic field that alternatively attracts and repulses said voice coil.

20. The compressor of claim 19, wherein two of said frame members comprise an electrically conductive material and two of said linear bearings are attached to the exterior of said voice coil in contact with said conductive material.

21. The compressor of claim 19, further comprising an electrically conductive rod coupled to said power supply and wherein said plurality of linear bearings consists of first and second linear bearings, said first linear bearing being mounted to said elongated actuator member in rolling engagement with said conductive rod and said second linear bearing being in rolling engagement with said actuator member.

22. The compressor of claim 19, wherein said former comprises a lightweight, dielectric material and said winding includes a thermally conductive material.

* * * * *